United States Patent [19]

Kuehler et al.

[11] Patent Number: 4,564,439

[45] Date of Patent: Jan. 14, 1986

[54] TWO-STAGE, CLOSE-COUPLED THERMAL CATALYTIC HYDROCONVERSION PROCESS

[75] Inventors: Christopher W. Kuehler, Larkspur; Arthur J. Dahlberg, Rodeo, both of Calif.

[73] Assignee: Chevron Research Company, San Francisco, Calif.

[21] Appl. No.: 625,937

[22] Filed: Jun. 29, 1984

[51] Int. Cl.[4] ..... C10G 65/12

[52] U.S. Cl. ..... 208/59; 208/89; 208/251 H; 208/211

[58] Field of Search ..... 208/59, 89, 251 H

[56] References Cited

U.S. PATENT DOCUMENTS

| | | | |
|---|---|---|---|
| 2,771,401 | 11/1956 | Shepherd | 208/210 |
| 3,901,792 | 8/1975 | Wolk et al. | 208/210 |
| 3,985,643 | 10/1976 | Milstein | 208/210 |
| 4,016,067 | 4/1977 | Fischer et al. | 208/89 |
| 4,212,729 | 7/1980 | Hensley, Jr. et al. | 208/210 |

*Primary Examiner*—John Doll
*Assistant Examiner*—O. Chaudhuri
*Attorney, Agent, or Firm*—S. R. La Paglia; W. K. Turner; Q. T. Dickinson

[57] ABSTRACT

A process for the production of transportation fuels from heavy hydrocarbonaceous feedstock is provided comprising a two-stage, close-coupled process, wherein the first stage comprises a hydrothermal zone into which is introduced a mixture comprising the feedstock, dispersed demetalizing contact particles having coke-suppressing activity, and hydrogen; and the second, close-coupled stage comprises a hydrocatalytic zone into which substantially all the effluent from the first stage is directly passed and processed under hydrocatalytic conditions.

16 Claims, No Drawings

TWO-STAGE, CLOSE-COUPLED THERMAL CATALYTIC HYDROCONVERSION PROCESS

BACKGROUND OF THE INVENTION

The present invention relates to processes for the hydroconversion of heavy hydrocarbonaceous fractions of petroleum. In particular, it relates to a close-coupled, two-stage process for the hydrothermal and hydrocatalytic conversion of petroleum residua having improved effectiveness for demetalation and inhibition of adverse coke formation in the first stage.

Increasingly, petroleum refiners find a need to make use of heavier or poorer quality crude feedstocks in their processing. As that need increases, the need also grows to process the fractions of those poorer feedstocks boiling at elevated temperatures, particularly those temperatures above 1000° F., and containing increasingly high levels of undesirable metals, sulfur, and coke-forming precursors. These contaminants significantly interfere with the hydroprocessing of these heavier fractions by ordinary hydroprocessing means. These contaminants are widely present in petroleum crude oils and other heavy petroleum hydrocarbon streams, such as petroleum hydrocarbon residua and hydrocarbon streams derived from coal processing and atmospheric or vacuum distillations. The most common metal contaminants found in these hydrocarbon fractions include nickel, vanadium, and iron. The various metals deposit themselves on hydrocracking catalysts, tending to poison or deactivate those catalysts. Additionally, metals and asphaltenes and coke precursors can cause interstitial plugging of catalyst beds and reduce catalyst life. Moreover, asphaltenes also tend to reduce the susceptibility of hydrocarbons to desulfurization processes. Such deactivated or plugged catalyst beds are subject to premature replacement.

Additionally, in two-stage processes similar to this, thermal hydrotreating reactors are very susceptible to the adverse formation of coke on various components of the reactor. In particular, it has been found that coke builds up significantly on the walls of the reactor and that this coke build-up, if unchecked, will eventually cause the reactor to plug up, thereby necessitating time-consuming and expensive rehabilitation. It is the intention of the present invention to overcome these problems by using a two-stage, close-coupled process, wherein the action of a first-stage hydrothermal reactor induces demetalation and some hydroconversion and suppresses adverse coke formation within the reactor, particularly on the reactor walls. The treated effluent from the first stage is then passed, close-coupled to a second-stage hydrocatalytic reactor where it is hydroprocessed to produce high yields of transportation fuel.

PRIOR ART

Various processes for the conversion of heavy hydrocarbonaceous fractions, particularly, multi-stage conversion processes include U.S. Pat. No. 4,366,047, Winter et al.; U.S. Pat. No. 4,110,192, Hildebrand et al.; U.S. Pat. No. 4,017,379, Iida et al.; U.S. Pat. No. 3,365,389, Spars et al.; U.S. Pat. No. 3,293,169, Kozlowski; U.S. Pat. No. 3,288,703, Spars et al.; U.S. Pat. No. 3,050,459, Shuman; U.S. Pat. No. 2,987,467, Keith et al.; U.S. Pat. No. 2,956,002, Folkins; and U.S. Pat. No. 2,706,705, Oettinger et al.

SUMMARY OF THE INVENTION

In accordance with the present invention, there is provided a two-stage, close-coupled process for the hydroprocessing of a heavy hydrocarbonaceous feedstock into transportation fuels boiling below 650° F. At least 30 volume percent of the feedstock boils above 1000° F. and the feedstock contains greater than 100 parts per million by weight of total metal contaminants.

The process comprises introducing a mixture comprising the feedstock and dispersed contact particles, the particles having sufficient catalytic activity to suppress adverse coke formation under incipient coking conditions and induce demetalation, into a first-stage hydrothermal zone in the presence of hydrogen. The feedstock and contact particle mixture is introduced into the hydrothermal zone preferably in upward essentially plug flow, under conditions sufficient to substantially demetalate the feedstock and to convert a significant amount of hydrocarbons in it boiling above 1000° F. to hydrocarbons boiling below 1000° F.

Substantially all or at least a substantial portion of the effluents of the first-stage hydrothermal zone is readily passed directly and preferably upflow, in a close-coupled manner, into a second-stage catalytic reaction zone at a reduced temperature relative to the first-stage hydrothermal zone. The effluent is contacted with hydroprocessing catalysts under hydroprocessing conditions, and the effluent from said second-stage catalytic reaction zone is recovered.

Alternatively, the catalytic contact particles are dispersed within the hydrocarbonaceous feedstock, hydrogen is added, and the resultant dispersion is heated to a temperature in the range of between 750° F. to 900° F. The heated dispersion is then introduced into the first-stage hydrothermal zone in upward essentially plug flow, and the processing proceeds as summarized above.

DETAILED DESCRIPTION OF THE INVENTION

The present invention is directed to a process for the hydroprocessing of heavy hydrocarbonaceous feedstocks, a significant portion of which boils above 1000° F., to produce high yields of transportation fuels boiling below 650° F. The process is a tow-stage, close-coupled process, the first stage of which encompasses a hydrothermal treating zone, wherein the feedstock is substantially demetalated while at the same time reducing or suppressing adverse coke formation within the first-stage reactor, particularly on the reactor walls. It is also anticipated that some hydrogenation may occur in the first-stage hydrothermal zone. The hydrothermally treated feedstock is then passed directly and without substantial loss of hydrogen partial pressure into a hydrocatalytic treatment zone, wherein the hydrothermal zone effluent is catalytically treated to produce an effluent suitable for further treatment into transportation fuels.

The feedstock finding particular use within the scope of this invention is any heavy hdrocarbonaceous feedstock, at least 30 volume percent, preferably 50 volume percent of which boils above 1000° F. and which has greater than 100 parts per million by weight total metallic contaminants. Examples of typical feedstocks include crude petroleum, topped crude petroleum, reduced crudes, petroleum residua from atmospheric or vacuum distillations, vacuum gas oils, solvent deasphalted tars and oils, and heavy hydrocarbonaceous liquids including residua derived from coal, bitumen, or coal tar pitches.

The heavy hydrocarbonaceous feedstocks finding particular use in this invention contain very high and undesirable amount of metallic contaminants. While various metals or soluble metal compounds may be present in the feedstock, the most debilitating include nickel, vanadium, and iron. These metallic contaminants cause hydroprocessing catalysts to deteriorate rapidly and as well as adversely affecting selectivity. Depending on the metal, the contaminants can enter the catalyst pores (nickel and vanadium) or plug the interstices in the catalyst particles (iron). The result is deactivation of the catalyst, and/or plugging or an increase in the pressure drop in a fixed bed reactor.

Thermal hydroprocessing of the heavy feedstocks of the present invention also gives rise to significant and adverse amounts of adverse coke formation particular on the surfaces of the reactor, and more particularly on the walls of the reaction vessel. It has been found that using the catalytic contact particles of the present invention significantly reduces the coke formation in a thermal reactor, especially on the walls, and that the coke formed is deposited on the particles thermselves as opposed to the reactor walls and thereby removed from the reactor. If not removed, the coke will build up and eventually plug the reactor. The precipitation of asphaltenes and other coke precursors is also significantly reduced using the contact particles in the thermal stage.

In the preferred embodiment of the present invention, contact particles are mixed with the heavy hydrocarbonaceous feed to form a slurry, preferably a dispersion or uniform distribution of particles within the feed, which is introduced into a first-stage thermal reactor. The contact particles are present in the mixture in a concentration relative to the feedstock of from about 0.01 to 10.0 percent by weight, preferably 0.1 to 2.0 percent by weight. Suitable contact particles may be any fine porous or non-porous solid particulate having sufficient catalytic activity to suppress the adverse coke formation under incipient coking conditions and induce substantial demetalation. Ordinarily, the solid particles would derive their catalytic activity from the inclusion of metals or metal-containing compounds within them. The particles should also be finely divided, having a maximum diameter of about 40 mesh U.S. sieve series, and preferably unde 100 mesh, and an average diameter of from 5 microns to 50 microns. Examples of suitable contact particles include mineral wastes, particularly the residue of aluminum processing, better known as 37 red mud", which contains significant amount of iron as an included metal; spent catalyst fines; coal-derived solids such as coal ash; alpha-$Fe_2O_3$; and other metal-containing, particularly iron-containing, finely dispersed or ground solid particulates.

The feedstock particulate mixture is introduced into the first-stage hydrothermal zone. Hydrogen is also introduced, either co-currently or counter-currently, to the flow of the feedstock-particulate slurry, and may constitute either fresh hydrogen, recycled gas, or a mixture thereof. The reactant mixture is then heated to a temperature of between 750° F. to 900° F., preferably 800° F. to 850° F. The feed may flow upwardly or downwardly in the hydrothermal reaction zone, but it is preferred that it flow upward. Preferably, the hydrothermal zone is configured such that plug flow conditions are approached.

Other reaction conditions in the hydrothermal zone include a residence time of from 0.01 to 3 hours, preferably 0.5 to 1.5 hour; a pressure in the range of 35 to 680 atmospheres, preferably 100 to 340 atmospheres, and more preferably 100 to 200 atmospheres; and a hydrogen gas rate of 355 to 3550 liters per liter of feed mixture and preferably 380 to 1780 liters per liter of feed mixture. Under these conditions, the feedstock is substantially demetalated and a significant amount of the hydrocarbons in the feedstock boiling above 1000° F. are converted to hydrocarbons boiling below 1000° F. In the preferred embodiment, the significant amount of hydrocarbons boiling above 1000° F. converted to those boiling below 1000° F. is at least 80 percent, more preferably 85 percent to 95 percent.

The effluent from the hydrothermal reactor zone is directly and rapidly passed (through a cooling zone and) into a second-stage catalytic reaction zone. In this invention, the two primary stages or zones are close-coupled, referring to the connective relationship between those zones. In this close-coupled system, the pressure between the hydrothermal zone and the hydrocatalytic zone is maintained such that there is no substantial loss of hydrogen partial pressure. In a close-coupled system also, there is preferably no solids separation effected on the feed as it passes from one zone to the other, and there is no more cooling and reheating than necessary. However, it is preferred to cool the first-stage effluent by passing it through a cooling zone prior to the second stage. This cooling does not affect the close-coupled nature of the system. The cooling zone will typically contain a heat exchanger or similar means, whereby the effluent from the hydrothermal reactor zone is cooled to a temperature between at least 15° F. to 200° F. below that of the temperature of the hydrothermal zone. Some cooling may also effected by the addition of fresh, cold hydrogen if desired. It may also by desirable to subject the effluent to a high pressure flash between stages. In this procedure, the first-stage effluent is run into a flash vessel operating under reaction conditions. Separated vapors are removed and the flash bottoms are sent to the cooling zone to reduce the temperature of the first-stage effluent. Additional hydrogen may be added. Again, as the flash is still carried out with no substantial loss of hydrogen pressure through the system, the close-coupled nature of the system is maintained.

The catalytic reaction zone is preferably a fixed bed type, but an ebullating or moving bed may also be used. While it is preferable that the mixture pass upward to the reaction zone to reduce catalyst fouling by the solid particulate, the mixture may also pass downwardly.

The catalyst used in the hydrocatalytic zone may be any of the well-known, commercially available hydroprocessing catalysts. A suitable catalyst for use in the hydrocatalytic reaction zone comprises a hydrogenation component supported on a suitable refractory base. Suitable bases include silica, alumina, or a composite of two or more refractory oxides such as silica-alumina, silica-magnesia, silica-zirconia, alumina-boria, silica-titania, silica-zirconia-titania, acid-treated clays, and the like. Acidic metal phosphates such as alumina phosphate may be also be used. The preferred refractory bases include alumina and composites of silica and alumina. Suitable hydrogenation components are selected from Group VI-B metals, Group VIII metals and their oxides, or mixture thereof. Particularly useful are cobalt-molydenum, nickel-molybdenum, or nickel-tungsten on silica-alumina supports.

In the hydrocatalytic reaction zone, hydrogenation and cracking occur simultaneously, and the higher-molecular-weight compounds are converted to lower-molecular-weight compounds. The product will also have been substantially desulfurized, denitrified, and deoxygenated.

In the process parameters of the hydrocatalytic zone, it is preferred to maintain the temperature below 800° F., preferably in the range of 650° F. to 800° F., and more preferably between 650° F. to 750° F. to prevent catalyst fouling. Other hydrocatalytic conditions include a pressure from 35 atmospheres to 680 atmospheres, preferably 100 atmospheres to 340 atmospheres; a hydrogen flow rate of 355 to 3550 liters per liter of feed mixture, preferably 380 to 1780 liters per liter of feed mixture; and a feed-liquid hourly space velocity in the range of 0.1 to 2, preferably 0.2 to 0.5.

Preferably, the entire effluent from the hydrothermal zone is passed to the hydrocatalytic zone. However, since small quantities of water and light gases ($C_1$ to $C_4$) are produced in the hydrothermal zone, the catalyst in the second stage may be subjected to a slightly lower hydrogen partial pressure than if these materials were absent. Since higher hydrogen partial pressures tend to increase catalyst life and maintain the close-coupled nature of the system, it may be desired in a commercial operation to remove a portion of the water and light gases before the stream enters the hydrocatalytic stage. Furthermore, interstage removal of the carbon monoxide and other oxygen-containing gases may reduce the hydrogen consumption in the hydrocatalytic stage due to the reduction of carbon oxides.

The product effluent from the hydrocatalytic reaction zone may be separated into a gaseous fraction and a solids-liquids fraction. The gaseous fraction comprises light oils boiling below about 150° F. to 270° F. and normally gaseous components such as hydrogen, carbon monoxide, carbon dioxide, water, and the $C_1$ to $C_4$ hydrocarbons. Preferably, the hydrogen is separated from the other gaseous components and recycled to the hydrothermal or hydrocatalytic stages. The solids-liquids fraction may be fed to a solid separation zone, wherein the insoluble solids are separated from the liquid by conventional means, for example, hydroclones, filters, centrifugal separators, cokers and gravity settlers, or any combination of these means.

The process of the present invention produces extremely clean, normally liquid products suitable for use as transportation fuels, a significant portion of which boils below 650° F. The normally liquid products, that is, all of the product fractions boiling above $C_4$, have a specific gravity in the range of naturally occurring petroleum stocks. Additionally, the product will have at least 80 percent of sulfur removed and at least 30 percent of nitrogen. The process may be adjusted to produce the type of liquid products that are desired in a particular boiling point range. Additionally, those products boiling in the transportation fuel range may require additional upgrading or clean up prior to use as a transportation fuel.

The following example demonstrates the synergistic effects of the present invention and are presented to illustrate a specific embodiment of the practice of this invention and should not be interpreted as a limitation upon the scope of that invention.

EXAMPLE

A slurry consisting of 99.75 weight percent Hondo atmospheric residuum and 0.25 weight percent mineral waste was passed sequentially through a first-stage, thermal hydrotreatment zone and a second-stage, catalytic hydrotreatment zone. The atmospheric residuum was a 650° F.+ fraction which had the following characteristics:

| FEED ID | Hondo atm. residuum |
|---|---|
| N, wt % | 0.84 |
| S, wt % | 5.92 |
| DISTILLATION (D-1160), LV % | |
| 650° F.− | 4.4 |
| 650° F.-1000° F. | 43.6 |
| 1000° F.+ | 52.0 |
| RAMS CARBON, wt % | 11.9 |
| METALS, ppm | |
| Ni | 109 |
| V | 284 |
| Fe | 8 |

The mineral waste was a by-product of aluminum refining and had the following characteristics:

| Metal, Wt % | |
|---|---|
| Fe | 26.7 |
| Al | 7.0 |
| Ti | 5.0 |
| Ca | 9.8 |
| Si | 2.3 |
| **Particle Size** | **Microns** |
| Median | 7 |
| 5/95 | 1/40 |
| **Physical Properties** | |
| Pore Volume, cc/g | 0.43 |
| Surface Area, $m^2/g$ | 50 |
| Mean Micropore Dia., A | 276 |

Hydrogen was introduced into the thermal zone at a rate of 1780 $m^3/m^3$ of slurry. The slurry had a residence time of approximately one hour in the thermal zone which was maintained at a pressure of 163 atmospheres, a temperature of 850° F., and a slurry hourly space velocity (SHSV) of 1.0 based upon the feed slurry. The effluent mixture of gases, liquids, and solids was passed to the second stage which was maintained at 740° F. and also at 163 atmospheres. The second stage contained a fixed bed of hydroprocessing catalyst comprising a half charge cobalt/molybdenum on alumina and a half charge nickel/molybdenum on alumina. A space velocity in the catalytic hydrotreatment reactor was maintained at 0.4/hr based upon the feed slurry. From analyses of the catalytic hydrotreatment reactor effluent, the following results were calculated:

| CONVERSIONS, % | |
|---|---|
| 1000+/1000−[1] | 91 |
| 650+/650−[1] | 60 |
| N | 55 |
| S | 98 |
| Ramsbottom Carbon | 95 |
| Ni | 88 |
| V | 99 |
| Fe | — |
| $H_2$ Consumption, | 1900 |

-continued

| CONVERSIONS, % |
|---|
| SCF/Bbl residuum |

[1]LV % by D-1160

What is claimed is:

1. A two-stage, close-coupled process for hydroprocessing a heavy hydrocarbonaceous feedstock at least 30 volume percent of which boils above 1000° F. and having greater than 100 parts per million by weight total metal contaminants to produce high yields of transportation fuels boiling below 650° F., which comprises:

(a) introducing said feedstock and dispersed contact particles having activity sufficient to suppress adverse coke formation under coking conditions and having demetalizing activity, into a first-stae hydrothermal zone in the presence of hydrogen; wherein said feedstock and contact particles are introduced into said hydrothermal zone under conditions sufficient to substantially demetalate said feedstock and to convert a significant amount of the hydrocarbons in said feedstock boiling above 1000° F. to hydrocarbons boiling below 1000° F.;

(b) rapidly and without substantial reduction of pressure through the system passing a substantial portion of the substantially demetalated, contact particle-entrained effluent of said first-stage hydrothermal zone directly into a second-stage catalytic reaction zone at a reduced temperature relative to said first-stage hydrothermal zone and contacting said effluent with hydroprocessing catalyst under hydroprocessing conditions, including a temperature in the range of 650° F. to 800° F.; and (c) recovering the effluent from said catalytic reactor zone.

2. A two-stage, close-coupled process for hydroprocessing a heavy hydrocarbonaceous feedstock at least 30 volume percent of which boils above 1000° F. and having greater than 100 parts per million by weight total metal contaminants to produce high yields of transportation fuels boiling below 650° F., which comprises:

(a) forming a slurry by dispersing within said feestock contact particles having activity sufficient to suppress adverse coke formation under coking conditions and demetalizing activity, in the presence of hydrogen;

(b) introducing said slurry into a first-stage hydrothermal zone under conditions sufficient to substantially demetalate said feedstock and to convert a significant amount of the hydrocarbons in said feedstock boiling above 1000° F. to hydrocarbons boiling below 1000° F.;

(c) rapidly and without substantial reduction of pressure through the system passing a substantial portion of the substantially demetalated, contact particle-entrained effluent of said first-stage hydrothermal zone directly into a second-stage catalytic reaction zone at a reduced temperature relative to said first-stage hydrothermal zone and contacting said effluent with hydroprocessing catalyst under hydroprocessing conditions, including a temperature in the range of 650° F. to 800° F.; and (d) recovering the effluent from said catalytic reaction zone.

3. The process as claimed in claim 1 or 2 wherein substantially all of the effluent from said first-stage hydrothermal zone is passed into said second-stage catalytic reaction zone.

4. The process as claimed in claim 1 or 2 wherein the temperature of said first-stage hydrothermal zone is maintained within a range of between 750° F. to 900° F.

5. The process as claimed in claim 4 wherein the temperature of said second-stage zone is between 15° F. to 200° F. below that of said first-stage zone.

6. The process as claimed in claim 1 or 2 wherein said feedstock-contact particle mixture is introduced into said hydrothermal zone in an upward, essentially plug flow manner, and the effluent of said first-stage into said catalytic zone in an upward manner.

7. The process as claimed in claim 1 or 2 wherein the amount of hydrocarbons in the feedstock boiling about 1000° F. which is converted to hydrocarbons boiling below 1000° F. is at least 80 percent.

8. The process as claimed in claim 1 or 2 wherein said metal contaminants in the feedstock include nickel, vanadium, and iron.

9. The process as claimed in claim 1 or 2 wherein said heavy hydrocarbonaceous feedstock is crude petroleum, topped crude petroleum, reduced crudes, petroleum residua from atmospheric or vacuum distillations, vacuum gas oils, solvent deasphalted tars and oils, and heavy hydrocarbonaceous liquids derived from coal, bitumen, or coal tar pitches.

10. The process as claimed in claim 1 or 2 wherein said contact particles are non-carbonaceous.

11. The process as claimed in claim 10 wherein the activity of said contact particles results from included metals within said particles.

12. The process as claimed in claim 1 or 2 wherein the concentration of said particles within said feedstock is from 0.01 to 10.0 percent by weight.

13. The process as claimed in claim 1 or 2 wherein the catalyst in said second-stage catalytic reaction zone is maintained in a supported bed within the reaction zone.

14. The process as claimed in claim 1 or 2 wherein the process is maintained at a hydrogen partial pressure from 35 atmospheres to 680 atmospheres.

15. The process as claimed in claim 14 wherein the hydrogen partial pressure is maintained between 100 atmospheres to 340 atmospheres.

16. The process as claimed in claim 1 or 2 wherein a substantial portion of the hydroprocessing catalyst in the catalytic reaction zone is a hydrocracking catalyst comprising at least one hydrogenation component selected from Group VI or Group VIII of the Periodic Table, and is supported on a refractory base.

* * * * *